US005523010A

United States Patent [19]

Sörensen et al.

[11] Patent Number: 5,523,010

[45] Date of Patent: Jun. 4, 1996

[54] USE OF 1,3-DIOXANES IN LUBRICANT AND RELEASE AGENTS

[75] Inventors: Kent Sörensen, Perstorp; Lars-Olof Garpvall, Helsingborg; Mats Johansson, Lund, all of Sweden

[73] Assignee: Perstorp AB, Perstorp, Sweden

[21] Appl. No.: 360,738

[22] PCT Filed: May 19, 1993

[86] PCT No.: PCT/SE93/00446

§ 371 Date: Dec. 22, 1994

§ 102(e) Date: Dec. 22, 1994

[87] PCT Pub. No.: WO94/00539

PCT Pub. Date: Jan. 6, 1994

[30] Foreign Application Priority Data

Jun. 26, 1992 [SE] Sweden ..... 9201978

[51] Int. Cl.[6] ..... C10M 129/20

[52] U.S. Cl. ..... 252/52 R; 252/51.5 A; 252/56 R; 549/369; 549/372; 549/374

[58] Field of Search ..... 549/369, 372, 549/374; 252/52 R

[56] References Cited

U.S. PATENT DOCUMENTS

| | | | |
|---|---|---|---|
| 3,024,249 | 3/1962 | Wöllner | 549/372 |
| 3,267,084 | 8/1966 | Rankin et al. | 549/374 |
| 3,376,315 | 4/1968 | Burger et al. | 549/374 |
| 3,846,319 | 11/1974 | Hotten | 549/369 |
| 4,076,727 | 2/1978 | Zey et al. | 549/372 |
| 4,077,982 | 3/1978 | Young et al. | 549/372 |
| 4,372,880 | 2/1983 | Upadek et al. | 549/369 |
| 4,590,226 | 5/1986 | Brown et al. | 549/374 |

FOREIGN PATENT DOCUMENTS

WO88/05071 7/1988 WIPO .

*Primary Examiner*—Ellen M. McAvoy
*Attorney, Agent, or Firm*—Scully, Scott, Murphy & Presser

[57] ABSTRACT

A process of lubricating or releasing comprising disposing a lubricant release composition between frictional contacting parts or between parts to be released from each other, respectively, wherein the composition includes 5-alkyl-1,3-dioxane-5-methanol and esters and/or ethers thereof, the alkyl in the aforementioned compounds being methyl or ethyl.

20 Claims, No Drawings

USE OF 1,3-DIOXANES IN LUBRICANT AND RELEASE AGENTS

The present invention relates to the use of a component based on 1,3-dioxane compounds, especially 1,3-dioxane alcohols, and derivatives thereof in lubricant and release agents. This invention also relates to a lubricant and release agent based on or containing 1,3-dioxane compounds as above.

Lubricant and release agents are normally used in connection with metal cutting, tapping, threading, reaming etc. as well as for concrete casting. Further and frequent application areas include utensils and plants for refrigeration, air conditioners, jet and conventional combustion engines, hydraulic fluids and the like.

Above exemplified application areas most often involve lubricant and release agents based on or containing mineral oils and one or more property adjusting additives such as EP-additives (EP=Extreme Pressure). EP-additives are mostly based on chloric, sulphuric and/or phosphatic compounds of the paraffin type.

Products containing mineral oils give rise to oil mist with pendant oil-polluted air and oil coated equipments in and around a working area. Mineral oils and for instance EP-additives are furthermore known to cause skin irritation, eczema and/or allergic reactions. Carcinogenic effects can not be excluded, as most mineral oils contain for example aromatic hydrocarbons of the benzopyrene type, which compounds at high working temperatures most probably form carcinogenic polyaromatics.

Mineral oils as well as chloric, sulphuric and/or phosphatic compounds give also rise to undesirable ecological effects, such as gradual concentration of undesired compounds like chlorine, sulphur and/or phosphorous in soil and water. Furthermore, mineral oils are not or only to a very low extent biodegradable, while the component according to the invention per se is biodegradable and based on biodegradable substances.

Mineral oils have per sea limited lubricating and releasing power, why a number of additives must be admixed. Besides property adjusting additives must for instance waterborne emulsions of mineral oils and synthetic lubricants comprise compounds such as emulsifiers and biocides, which compounds may irritate the skin and/or the respiratory passage.

According to the present invention, it has surprisingly been possible to solve above discussed problems by a replacement of mineral oils and/or property adjusting additives with a component based on 1,3-dioxane compounds and/or derivatives thereof.

The lubricating properties have furthermore been improved by utilisation of the component as additive in lubricant and release agents. An addition is performed without any further alteration of the original composition. A suitable addition level is 0.1–20% by weight, preferably 0.5–10% by weight, calculated on included active substances.

The component is of the general formula

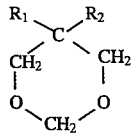

in which formula $R_1$ is —H, —OH, —$CH_3$, —$C_2H_5$, —$CH_2OR_3$, —$CH_2O(C_2H_4O)_nR_3$, —$CH_2O(C_3H_6O)_nR_3$, —$CH_2(C_4H_8O)_nR_3$, —$CH_2O(C_8H_8O)_nR_3$, —$CH_2O(R_5)_m(R_6)_pR_3$ or —$CH_2OR_7$ and $R_2$ is —H, —OH, —$OR_4$, —$O(C_2H_4O)_nR_4$, —$O(C_3H_6O)_nR_4$, —$O(C_4H_8O)_nR_4$, —$O(C_8H_8O)_nR_4$, —$CH_2OR_4$, —$CH_2O(C_2H_4O)_nR_4$, —$CH_2O(C_3H_6O)_nR_4$, —$CH_2O(C_4H_8O)_nR_4$, —$CH_2O(C_8H_8O)_nR_4$, —$O(R_5)_m(R_6)_pR_4$, —$CH_2O(R_5)_m(R_6)_pR_4$, —$OR_7$ or —$CH_2OR_7$.

$R_3$ and/or $R_4$ is each independently selected from any of the below groups:

(i) hydrogen;

(ii) an alkyl moiety;

(iii) a substituted-alkyl moiety;

(iv) an alkenyl moiety;

(v) a substituted alkenyl moiety;

(vi) a cycloalkyl moiety;

(vii) a substituted cycloalkyl moiety;

(viii) a cycloalkenyl moiety;

(ix) a substituted cycloalkenyl moiety;

(x) an aryl moiety;

(xi) a substituted aryl moiety;

(xii) an aralkyl moiety, an alkaryl moiety, an aralkenyl moiety and/or an alkenaryl moiety.

$R_5$ and $R_6$ are two different substituents of the formula $C_xH_yO$ wherein x is 2, 3, 4 or 8 and y is 4, 6 or 8. $R_7$ is defined by the general formula $$-\overset{\overset{\displaystyle O}{\|}}{C}-NH-R_8$$

in which the substituent $R_8$ is selected from any of the groups (ii) through (xii). The mean value $\bar{n}$ for n is 1–60, preferably 1–20, the mean values $\bar{m}$ for m and $\bar{p}$ for p is 1–59, preferably 1–19 and the sum of the mean values $\bar{m}$ and $\bar{p}$ is 2–60, preferably 2–20.

According to one embodiment of the invention, $R_1$ and/or $K_2$ is hydroxyl. In such an embodiment of the invention, the used component is a 1,3-dioxane alcohol, such as 1,3-dioxane-5-ol, 5-ethyl-1,3-dioxane-5-methanol, 1,3-dioxane-5,5-dimethanol and/or adducts thereof with for instance ethylene oxide, propylene oxide, butylene oxide and/or styrene oxide. One or more of the carbon atoms in the 1,3-dioxane ring can, furthermore, be methyl, ethyl, butyl, propyl, pentyl, hexyl, heptyl, octyl, nonyl, decyl, undecyl, dodecyl, ethenyl, butenyl, propenyl, pentenyl, hexenyl, heptenyl, octenyl, nonenyl, decenyl, undecenyl and/or dodecenyl substituted.

The component is in above embodiment used as 100% product or in diluted form and is employed as sole constituent or as additive in a lubricant or release agent. The component can as additive suitably comprise 1–80% by weight, preferably 40–80% by weight, calculated on the total formulation.

In a further embodiment, $R_3$ and $R_4$ are each independently selected from any of the groups (ii) through (xii) preferably derived from one or more carboxylic acids having 1–6 carboxyl groups and 1–24 carbon atoms, such as abietic acid, acetic acid, behenic acid, benzoic acid, p-tert.butylbenzoic acid, butyric acid, castor fatty acid, dehydrated castor fatty acid, capric acid, caproic acid, caprylic acid, coconut fatty acid, cottonseed fatty acid, crotonic acid, 2-ethylhexanoic acid, formic acid, groundnut fatty acid, heptanoic acid, lauric acid, licanic acid, linoic acid, linolenic acid, montanoic acid, myristic acid, nonanoic acid, isononanoic acid, oleic acid, palmitic acid, propionic acid, ricinoleic acid, soybean fatty acid, stearic acid, isostearic acid, tall oil fatty acid, tallow fatty acid, valeric acid, adipic acid, azelaic acid, fumaric acid, maleic acid or its anhydride, phthalic acid or its anhydride, isophthalic acid, tetrahydrophthalic acid or its anhydride, hexahydrophthalic acid or its anhydride, sebacic acid, succinic acid or its anhydride, citric acid, trimelletic acid or its anhydride, pyromelletic acid or its dianhydride and/or a mixture of two or more of these acids or anhydrides.

Embodiments in which $R_7$ is defined by the general formula $$-\overset{\overset{\displaystyle O}{\|}}{C}-NH-R_8$$

the component according to the invention comprises a reaction product and/or a derivative thereof derived from for instance a 1,3-dioxane alcohol as previously exemplified and at least one isocyanate having the general formula $O{=}C{=}N{-}R_8$. $R_8$ is in these embodiments preferably defined by having 4–48, most preferably 8–24 carbon atoms.

In yet a further embodiment $R_3$ and/or $R_4$ is each independently a group of the formula $$-R_9-\underset{\underset{\displaystyle O}{\|}}{C}-R_{10},\ -R_9-\underset{\underset{\displaystyle O}{\|}}{C}-R_{10}(C_2H_4O)_q,$$

$$-R_9-\underset{\underset{\displaystyle O}{\|}}{C}-R_{10}(C_3H_6O)_q,\ -R_9-\underset{\underset{\displaystyle O}{\|}}{C}-R_{10}(C_4H_8O)_q \text{ and/or}$$

$$-R_9-\underset{\underset{\displaystyle O}{\|}}{C}-R_{10}(C_8H_8O)_q$$

wherein the mean value $\bar{q}$ for q is 1–60, preferably 1–20 and $R_9$ is selected from any of the groups (ii) through (xii) preferably derived from one or more carboxylic acids having 2–6 carboxyl groups and 4–10 carbon atoms, such as adipic acid, azelaic acid, fumaric acid, maleic acid or its anhydride, phthalic acid or its anhydride, isophthalic acid, tetrahydrophthalic acid or its anhydride, hexahydrophthalic acid or its anhydride, sebacic acid, succinic acid or its anhydride, citric acid, trimelletic acid or its anhydride, pyromelletic acid or its dianhydride and/or a mixture of two or more of these acids and $R_{10}$ is hydroxyl or selected from any of the groups (ii) through (xii) derived from one or more alcohols having 1–8 hydroxyl groups and 1–24 carbon atoms, such as methanol, ethanol, butanol, isobutanol, propanol, isopropanol, pentanol, hexanol, octanol, 2-ethylhexanol, ethoxyethanol, cetyl alcohol, trimethylol-propane diallyl ether, pentaerythritol triallyl ether, glycerol diallyl ether, 1,3-dioxane-5-ol, cyclohexane-dimethanol, 5-ethyl-1,3-dioxane-5-methanol, 1,3-butanediol, 1,4-butanediol, 1,6-hexanediol, pentanediol, neopentyl glycol, hexylene glycol, 2-methyl-1,3-propanediol, 2-methyl-2-ethyl1,3-propanediol, 2-methyl-2-butyl-1,3-propanediol, 2-ethyl-2-butyl-1,3-propanediol, trimethylpentanediol, trimethylol-propane monoallyl ether, pentaerythritol diallyl ether, glycerol monoallyl ether, 1,3-dioxane-5,5-dimethanol, glycerol, trimethylolethane, trimethylolpropane, pentaerythritol monoallyl ether, pentaerythritol, ditrimethylolpropane, dipentaerythritol, tripentaerythritol, sorbitol and/or a mixture of two or more of these alcohols.

In alternative embodiments, $R_3$, $R_4$, $R_9$ and/or $R_{10}$ is each independently selected from any of the groups (ii) through (xii) preferably derived from one or more hydroxycarboxylic acids having 1–3 carboxyl groups, 1–4 hydroxyl groups and 2–24 carbon atoms, such as dimethylolpropionic acid and hydroxypivalic acid. $R_3$ and/or $R_4$ can also be selected from group (xii) wherein the alkyl moiety derived from one or more glycidyl esters of monofunctional carboxylic acids having 1–24 carbon atoms or each independently be selected from any of the groups (ii) through (xii) derived from one or more α-epoxides having 5–24 carbon atoms.

In embodiments of the component holding one or more unreacted carboxyl groups these groups can, in order to obtain a water dilutability, be neutralised with a suitable basic compound such as ammonia, an amine, a hydroxide or the like. Ammonia or an amine such as monoethanol amine, diethanol amine, triethanol amine, N,N-dimethylethanol amine, N,N-dimethylaminomethylpropanol, aminomethylpropanol, triethyl amine and/or morpholine are preferred neutralising agents.

Advantages obtained by the present invention include improved working conditions, which conditions are improved through a replacement of mineral oils and/or additives, whereby the skin irritating, allergic and/or eczema producing properties of these compounds are eliminated or reduced. Furthermore, problems caused by oil mist and oil coating can be avoided or reduced by selecting the substituents $R_1$–$R_{10}$ in such a way within the scope of the claims that a reduced volatility, compared to normally used mineral oils, is obtained. The ecological disadvantages of using mineral oils and for instance chloric, sulphuric and/or phosphatic additives and the like are, due to the biodegradability of the component according to the invention as well as due to the fact that the component does not contain chloric, sulphuric and/or phosphatic substances, avoided.

Further advantages obtained by using the component according to the invention include improved and excellent lubricating power, excellent thermal stability and excellent solubility in most organic media.

The component according to the present invention can suitably be utilised as additive to compositions as disclosed in the American patent 4,405,471 and the European patent application 89 913 158.5 or replace components included in said compositions. Esters forming part of a lubricating fluid as described in for instance Examples 8–14 of above American patent and Examples 8–12 of above European patent application can be combined with or wholly and/or partly replaced by esters prepared from one or more 1,3-dioxane alcohols and/or derivatives thereof such as alkoxylated 1,3-dioxane alcohols and one or more suitable acids, as previously disclosed, which esters possibly have been neutralised with a suitable amine or the like.

The invention will be further explained in connection with enclosed examples in which some preferred embodiments of the invention are disclosed as follows:

Example 1: Preparation of 5-ethyl-1,3-dioxane-5-methanol used as final or intermediate product according to the invention.

Examples 2 and 3: Preparations of monoesters of 5-ethyl-1,3-dioxane- 5-methanol used as final or intermediate product according to the invention.

Examples 4–6: Evaluations of lubricant agents, cutting fluids, containing esters prepared according to Examples 2 and 3.

Examples 7 and 8: Evaluations of the lubricating power of the products obtained according to Examples 1 and 2.

Example 9: Evaluation of release agents in concrete casting. The release agents are based on products obtained according to Examples 1 and 3 and are compared with a commercial release agent.

The present invention is not limited to disclosed embodiments. The component according to invention as well as its properties can be varied within the scope of the claims by selecting the substituents $R_1$–$R_{10}$ to comply with particular requirements.

EXAMPLE 1

3.0 moles of trimethylolpropane, 3.6 moles of paraformaldehyde (94%) and 0.40 g of paratoluene sulphonic acid were charged and mixed in a 4-necked reaction flask equipped with a nitrogen inlet, a stirrer and a cooler provided with a water-trap (Dean-Stark). The mixture was under stirring heated to 130° C. and kept at this temperature for 60 minutes. Obtained reaction product was neutralised with powdered sodium hydroxide and thereafter vacuum distilled using a short Vigreaux column, which distillation resulted in the following fractions:

| | Boiling point | Pressure | Amount |
|---|---|---|---|
| Fraction I: | 100° C. | 2 mm Hg | 90 g |
| Fraction II: | 100–105° C. | 2 mm Hg | 168 g |
| Fraction III: | 105–150° C. | 1 mm Hg | 8 g |
| Residue: | — | — | 171 g |

Fraction I and II, colourless or slightly yellowish liquids, were mixed and analytically determined to be 5-ethyl-1,3-dioxane- 5-methanol having the following properties:

| | |
|---|---|
| Content: | >98% |
| Moisture content: | <0.05% |
| Ash content: | <0.5% |
| Viscosity at 23° C.: | ≈80 mPas |
| Density at 23° C.: | ≈1.09 g/cm$^3$ |

EXAMPLE 2

1.70 mole of 5-ethyl-1,3-dioxane-5-methanol (obtained in Example 1), 1.615 mole of oleic acid (Edinor TiO5, Henkel KGaA, Fed. Rep. of Germany), 3.5 g of trisnonylphenyl phosphite (antioxidant) and 21 g of xylene (azeotropic solvent) were charged and mixed in a 4-necked reaction flask equipped with a nitrogen inlet, a stirrer and a cooler provided with a water-trap (Dean-Stark). The temperature was raised to 120° C., whereupon 1.4 g of zinc powder (esterification catalyst) was added. The temperature of the reaction mixture was now raised to 230° C. and maintained until an acid value of less than 2 mg KOH/g was obtained, whereupon the remaining xylene was evaporated at a vacuum of 15 mm Hg. The resulting product was cooled to room temperature, a filter aid (Celite) was added in an amount of 2% and the product was filtered to remove organozinc compounds.

Obtained monoester of 5-ethyl-1,3-dioxane-5-methanol and oleic acid, exhibited the following properties:

| | |
|---|---|
| Acid value: | 1.9 mg KOH/g |
| Hydroxyl value: | 7 mg KOH/g |
| Viscosity at 23° C.: | 47 mPas |
| Colour value: | 4–5 Gardner |

EXAMPLE 3

2.40 moles of 5-ethyl-1,3-dioxane-5-methanol (obtained in Example 1), 2.28 moles of caprylic-capric acid ($C_8$–$C_{10}$ acids, Karlshamns AB, Sweden), 3.5 g of trisnonylphenyl phosphite (antioxidant), 21 g of xylene (azeotropic solvent) and 0.7 g of an esterification catalyst (Fascat 4100, M&T Chemicals B. V., The Netherlands) were charged and mixed in a 4-necked reaction flask equipped with a nitrogen inlet, a stirrer and a cooler provided with a water-trap (Dean-Stark). The temperature of the reaction mixture was raised to 230° C. and maintained until an acid value of less than 0.5 mg KOH/g was obtained. The remaining xylene was thereafter evaporated at a vacuum of 15 mm Hg and a temperature of 180° C. and the resulting product was cooled to room temperature.

Obtained monoester of 5-ethyl-1,3-dioxane-5-methanol and caprylic-capric acid, exhibited the following properties:

| | |
|---|---|
| Acid value: | 0.3 mg KOH/g |
| Hydroxyl value: | 13 mg KOH/g |
| Viscosity at 23° C.: | 31 mPas |
| Colour value: | 1–2 Gardner |

EXAMPLE 4

1.5% by weight of 5-ethyl-1,3-dioxane-5-methanol (obtained in Example 1) was added to a commercially available mineral oil based cutting fluid (Peralub 6000, Perstorp AB, Sweden) having a mineral oil content of 23% by weight. The two cutting fluids, the commercially available (Sample 1) and the 5-ethyl-1,3-dioxane-5-methanol modified (Sample 2), were diluted with water to an utility concentration of 5% by weight.

The two cutting fluids were evaluated by tapping in aluminium. The amount of aluminium adhering to the tap were visually determined and the result was used as a basis for grading the lubricating properties.

A grading of 1–5 was used, wherein:

1=Poor lubricating properties —A large amount of aluminium adheres to the tap.

5=Excellent lubricating properties —A very small amount or no aluminium adheres to the tap.

The following results were obtained:

| | Grading |
|---|---|
| Sample 1: | 3 |
| Sample 2: | 5 |

Above grading indicates that a small addition of 5-ethyl-1,3-dioxane-5-methanol, without any alteration of other included constituents, results in substantially increased lubricating properties.

EXAMPLE 5

Example 4 was repeated with the difference that 5-ethyl-1,3-dioxane- 5-methanol was replaced by the monoester obtained in Example 2.

Sample 1=Commercially available cutting fluid.

Sample 2=Monoester modified cutting fluid.

The following results were obtained:

| | Grading |
|---|---|
| Sample 1: | 3 |
| Sample 2: | 4 |

Above grading indicates that a small addition of the monoester of oleic acid and 5-ethyl-1,3-dioxane-5-methanol, without any alteration of other included constituents, results in increased lubricating properties.

EXAMPLE 6

Example 4 was repeated with the difference that 5-ethyl-1,3-dioxane- 5-methanol was replaced by the monoester obtained in Example 3.

Sample 1=Commercially available cutting fluid.

Sample 2=Monoester modified cutting fluid.

The following results were obtained:

| | Grading |
|---|---|
| Sample 1: | 3 |
| Sample 2: | 4 |

Above grading indicates that a small addition of the monoester of caprylic-capric acid and 5-ethyl-1,3-dioxane-5-methanol, without any alteration of other included constituents, results in increased lubricating properties.

EXAMPLE 7

1.5% by weight of 5-ethyl-1,3-dioxane-5-methanol (obtained in Example 1) was added to a commercially available mineral oil (Nyflex 810, Nynäs Petroleum AB, Sweden). The specific surface pressure was, for the two samples, determined according to the German V K I S Arbeitsblatt 6 of June 1975. A high specific surface pressure indicates a high lubricating power with pendant reduced abrasion of equipment such as taps, drills, cutters and the like.

Sample 1: Commercially available mineral oil. Sample 2: 5-ethyl-1,3-dioxane-5-methanol modified mineral oil.

The following results were obtained:

| | Specific Surface Pressure |
|---|---|
| Sample 1: | 10 N/mm$^2$ |
| Sample 2: | 20 N/mm$^2$ |

Above results give at hand that a small addition of 5-ethyl-1,3-dioxane-5-methanol to a mineral oil highly increases its lubricating power.

EXAMPLE 8

Example 7 was repeated with the difference that 5-ethyl-1,3-dioxane- 5-methanol was replaced by the monoester obtained in Example 2.

Sample 1: Commercially available mineral oil.

Sample 2: Monoester modified mineral oil.

The following results were obtained:

| | Specific Surface Pressure |
|---|---|
| Sample 1: | 10 N/mm$^2$ |
| Sample 2: | 25 N/mm$^2$ |

Above results give at hand that a small addition of the monoester of oleic acid and 5-ethyl-1,3-dioxane-5-methanol to a mineral oil highly increases its lubricating power.

EXAMPLE 9

A commercially available release agent (Lasol M100, Byggekemi i Nol AB, Sweden) based on mineral oil was evaluated in comparison with two embodiments of the invention Sample 1: A mixture of 40 g of 5-ethyl-1,3-dioxane-5-methanol (obtained in Example 1) and 60 g of water.
and Sample 2: The monoester (obtained in Example 3 ) of caprylic-capric acid and 5-ethyl-1,3-dioxane-5-methanol according to the following method:

A release agent is sprayed onto the inner side of a cubic steel cast, in which a cube of ordinary concrete, containing Standard Portland cement, is casted. The cube is after 24 hours released from the cast and a visual inspection with regard to adhering concrete is performed on the interior of the cast. The concrete cube is visually inspected with regard to surface roughness, hardness and blistering.

The amount of adhering concrete and the appearance of the surface of the concrete cube are bases for grading the release agent. The surface should be free from blisters, even and hard, while the interior of the cast should be free from adhering concrete.

A grading of 1–3 is used, wherein:

1=Not approved

3=Approved

The following results were obtained:

| | Grading |
|---|---|
| Commercial release agent: | 3 |
| Sample 1: | 3 |
| Sample 2: | 3 |

Above results show that the environmentally more suitable component according to the invention, can replace a mineral oil based release agent without deterioration of the technical properties.

We claim:

1. A process of lubricating or releasing comprising disposing a lubricant composition or a release composition between frictional contacting parts or between parts to be released from each other, respectively, said composition including a compound having the formula

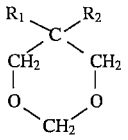

wherein $R^1$ is methyl or ethyl;

$R^2$ is $—CH_2OR_4$, $—CH_2O(C_2H_4O)_nR_4$, $—CH_2O(C_3H_6O)_nR_4$, $—CH_2O(C_4H_8O)_nR_4$, $—CH_2O(C_8H_8O)_nR_4$, $—O(R_5)_m(R_6)_pR_4$, $—CH_2O(R_5)_m(R_6)_pR_4$, $—OR_7$ or $—CH_2OR_7$;

$R_4$ is independently selected from the group consisting of:

(i) hydrogen;

(ii) an alkyl moiety;

(iii) a substituted alkyl moiety;

(iv) an alkenyl moiety;

(v) a substituted alkenyl moiety;

(vi) a cycloalkyl moiety;

(vii) a substituted cycloalkyl moiety;

(viii) a cycloalkenyl moiety;

(ix) a substituted cycloalkenyl moiety;

(x) an aryl moiety;

(xi) a substituted aryl moiety; and (xii) an aralkyl moiety, an alkaryl moiety, an aralkenyl moiety or an alkenaryl moiety;

$R_5$ and $R_6$ are different and are $C_xH_yO$, wherein x is 2, 3, 4 or 8 and y is 4, 6 or 8;

$R_7$ is $$-\overset{\overset{\displaystyle O}{\|}}{C}-NH-R_8;$$

$R_8$ is selected from the group consisting of any one of (ii) to (xii);

n has a mean value of 1 to 60;

m has a mean value of 1 to 59;

p has a mean value of 1 to 59; and the sum of the mean values of m and p is 2 to 60.

2. A process in accordance with claim 1 wherein n has a mean value of 1 to 20; m has a mean value of 1 to 19; p has a mean value of 1 to 19; and the sum of the mean values of m and p is 2 to 20.

3. A process in accordance with claim 1 wherein each $R_4$ is independently selected from the group consisting of (ii) to (xii) and is derived from one or more carboxylic acids having 1 to 6 carboxyl groups and 1 to 24 carbon atoms.

4. A process in accordance with claim 16 wherein each $R_4$ is independently selected from the group consisting of $$-R_9-\underset{\underset{\displaystyle O}{\|}}{C}-R_{10},\ -R_9-\underset{\underset{\displaystyle O}{\|}}{C}-R_{10}(C_2H_4O)_q,$$

$$-R_9-\underset{\underset{\displaystyle O}{\|}}{C}-R_{10}(C_3H_6O)_q,\ -R_9-\underset{\underset{\displaystyle O}{\|}}{C}-R_{10}(C_4H_8O)_q \text{ and}$$

$$-R_9-\underset{\underset{\displaystyle O}{\|}}{C}-R_{10}(C_8H_8O)_q$$

wherein $R_9$ is selected from the group consisting of (ii) to (xii) and is derived from one or more carboxylic acids having 2 to 6 carboxyl groups and 4 to 10 carbon atoms;

$R_{10}$ is hydroxyl or a group selected from the group consisting of (ii) to (xii) derived from one or more alcohols having 1 to 8 hydroxyl groups and 1 to 24 carbon atoms; and q has a mean value of 1 to 60.

5. A process in accordance with claim 4 wherein q has a mean value of 1 to 20.

6. A process in accordance with claim 1 wherein each $R_4$ is independently selected from the group consisting of an aralkyl moiety, an alkaryl moiety, an aralkenyl moiety and an alkenaryl moiety wherein said moieties are derived from one or more glycidyl esters of monofunctional carboxylic acids having 1 to 24 carbon atoms.

7. A process in accordance with claim 1 wherein each $R_4$ is independently selected from the group consisting of (ii) to (xii) derived from one or more α-epoxides having 5 to 24 carbon atoms.

8. A process in accordance with claim 1 wherein $R_4$, $R_9$ and $R_{10}$ are each independently selected from the group consisting of (ii) to (xii) derived from one or more hydroxycarboxylic acids having 1 to 3 carboxyl groups, 1 to 4 hydroxyl groups and 2 to 24 carbon atoms.

9. A process in accordance with claim 3 wherein each $R_4$ is independently derived from an acid selected from the group consisting of abietic acid, acetic acid, behenic acid, benzoic acid, p-tert-butylbenzoic acid, butyric acid, castor fatty acid, dehydrated castor fatty acid, capric acid, caproic acid, caprylic acid, coconut fatty acid, cottonseed fatty acid, crotonic acid, 2-ethylhexanoic acid, formic acid, groundnut fatty acid, heptanoic acid, lauric acid, licanic acid, linoic acid, linolenic acid, montanoic acid, myristic acid, nonanoic acid, isononanoic acid, oleic acid, palmitic acid, propionic acid, ricinoleic acid, soybean fatty acid, stearic acid, isostearic acid, tall oil fatty acid, tallow fatty acid, valeric acid, adipic acid, azelaic acid, fumaric acid, maleic acid or its anhydride, phthalic acid or its anhydride, isophthalic acid, tetrahydrophthalic acid or its anhydride, hexahydrophthalic acid or its anhydride, sebacic acid, succinic acid or its anhydride, citric acid, trimelletic acid or its anhydride, pyromelletic acid or its dianhydride and a mixture of two or more of the above.

10. A process in accordance with claim 1 wherein $R_8$ includes 4 to 48 carbon atoms.

11. A process in accordance with claim 10 wherein $R_8$ includes 8 to 24 carbon atoms.

12. A process in accordance with claim 4 wherein $R_9$ is a moiety derived from an acid selected from the group consisting of adipic acid, azelaic acid, fumaric acid, maleic acid or its anhydride, phthalic acid or its anhydride, isophthalic acid, tetrahydrophthalic acid or its anhydride, hexahydrophthalic acid or its anhydride, sebacic acid, succinic acid or its anhydride, citric acid, trimelletic acid or its anhydride, pyromelletic acid or its dianhydride and a mixture of two or more of the above.

13. A process in accordance with claim 4 wherein $R_{10}$ is a moiety derived from an alcohol selected from the group consisting of methanol, ethanol, butanol, isobutanol, propanol, isopropanol, pentanol, hexanol, octanol, 2-ethyl-hexanol, ethoxyethanol, cetyl alcohol, trimethylolpropane diallyl ether, pentaerythritol triallyl ether, glycerol diallyl ether, 1,3-dioxane- 5-ol, cyclohexanedimethanol, 5-ethyl-1,3-dioxane-5-methanol, 1,3-butanediol, 1,4-butanediol, 1,6-hexanediol, pentanediol, neopentyl glycol, hexylene glycol, 2-methyl-1,3propanediol, 2-methyl-2-ethyl-1,3-propanediol, 2-methyl-2-butyl-1,3-propanediol, 2-ethyl-2-butyl-1,3-propanediol, trimethylpentanediol, trimethylolpropane monoallyl ether, pentaerythritol diallyl ether, glycerol monoallyl ether, 1,3-dioxane- 5,5-dimethanol, glycerol, trimethylolethane, trimethylolpropane, pentaerythritol monoallyl ether, pentaerythritol, ditrimethylolpropane, dipentaerythritol, tripentaerythritol, sorbitol and a mixture of two or more of the above.

14. A process in accordance with any one of claims 1, 2, 3, 6, 8 or 9 wherein unreacted carboxyl groups are neutralized with at least one basic compound.

15. A process in accordance with claim 14 wherein said basic compound is ammonia or an amine.

16. A process in accordance with claim 15 wherein said basic compound is an amine selected from the group consisting of monoethanol amine, diethanol amine, triethanol amine, N,N-dimethylethanol amine, N,N-dimethylaminomethylpropanol, triethylamine, aminomethylpropanol and morpholine.

17. A lubricant or release agent comprising a 1,3-dioxane having the formula

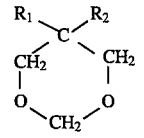

wherein $R_1$ is methyl or ethyl;

$R^2$ is $-CH_2OR_4$, $-CH_2O(C_2H_4O)_nR_4$, $-CH_2O(C_3H_6O)_nR_4$, $-CH_2O(C_4H_8O)_nR_4$, $-CH_2O(C_8H_8O)_nR_4$, $-O(R_5)_m(R_6)_pR_4$, $-CH_2O(R_5)_m(R_6)_pR_4$, $-OR_7$ or $-CH_2OR_7$;

$R_4$ is independently selected from the group consisting of:

(i) hydrogen;

(ii) an alkyl moiety;

(iii) a substituted alkyl moiety;

(iv) an alkenyl moiety;

(v) a substituted alkenyl moiety;

(vi) a cycloalkyl moiety;

(vii) a substituted cycloalkyl moiety;

(viii) a cycloalkenyl moiety;

(ix) a substituted cycloalkenyl moiety;

(x) an aryl moiety;

(xi) a substituted aryl moiety; and (xii) an aralkyl moiety, an alkaryl moiety, an aralkenyl moiety or an alkenaryl moiety;

$R_5$ and $R_6$ are different and are $C_xH_yO$, wherein x is 2, 3, 4 or 8 and y is 4, 6 or 8;

$R_7$ is $$-\overset{\overset{\displaystyle O}{\|}}{C}-NH-R_8;$$

$R_8$ is selected from the group consisting of (ii) to (xii);

n has a mean value of 1 to 60;

m has a mean value of 1 to 59;

p has a mean value of 1 to 59; and the sum of the mean values of m and p is 2 to 60.

18. An agent in accordance with claim 17 wherein n has a mean value of 1 to 20; m has a mean value of 1 to 19; p has a mean value of 1 to 19; and the sum of the mean values of m and p is 2 to 20.

19. An agent in accordance with claim 17 wherein $R_4$ is independently selected from the group consisting of $$-R_9-\underset{\underset{\displaystyle O}{\|}}{C}-R_{10},\ -R_9-\underset{\underset{\displaystyle O}{\|}}{C}-R_{10}(C_2H_4O)_q,$$

$$-R_9-\underset{\underset{\displaystyle O}{\|}}{C}-R_{10}(C_3H_6O)_q,\ -R_9-\underset{\underset{\displaystyle O}{\|}}{C}-R_{10}(C_4H_8O)_q \text{ and}$$

$$-R_9-\underset{\underset{\displaystyle O}{\|}}{C}-R_{10}(C_8H_8O)_q;$$

$R_9$ is selected from the group consisting of (ii) to (xii) and is derived from one or more carboxylic acids having 2 to 6 carboxyl groups and 4 to 10 carbon atoms;

$R_{10}$ is hydroxyl or is selected from the group consisting of (ii) to (xii) derived from one or more alcohols having 1 to 8 hydroxyl groups and 1 to 24 carbon atoms; and q has a mean value of 1 to 60.

20. An agent in accordance with claim 19 wherein q has a mean value of 1 to 20.

* * * * *

UNITED STATES PATENT AND TRADEMARK OFFICE

CERTIFICATE OF CORRECTION

PATENT NO. : 5,523,010

DATED : June 4, 1996

INVENTOR(S) : Kent Sorensen, et al.

It is certified that error appears in the above-indentified patent and that said Letters Patent is hereby corrected as shown below:

Column 2, line 1: " $-CH_2(C_4H_8O)$ " should read -- $-CH_2O(C_4H_8O)$ --.

Column 2, line 38: "$K_2$ " should read --$R_2$ --

Column 3, line 53: "ethyll" should read -- ethyl-l --

Column 10, line 66, Claim 17: " $-O(R_5)$ " should read -- $-O(R_5)$ --.

Signed and Sealed this

Twelfth Day of November, 1996

*Attest:*

BRUCE LEHMAN

*Attesting Officer*

*Commissioner of Patents and Trademarks*